United States Patent [19]

Tonnelli

[11] Patent Number: 4,928,522

[45] Date of Patent: May 29, 1990

[54] STEAM INJECTION SURVEY APPARATUS AND METHOD FOR TESTING WELLS

[75] Inventor: Gerald J. Tonnelli, Bakersfield, Calif.

[73] Assignee: Production Data, Inc., Bakersfield, Calif.

[21] Appl. No.: 308,519

[22] Filed: Feb. 10, 1989

[51] Int. Cl.[5] ..... E21B 49/00

[52] U.S. Cl. ..... 73/155; 166/252

[58] Field of Search ..... 73/151, 155; 166/75.1, 166/90, 252, 272; 436/25, 27, 28, 29

[56] References Cited

U.S. PATENT DOCUMENTS

| | | | |
|---|---|---|---|
| 4,169,504 | 10/1979 | Scott | 166/90 |
| 4,817,713 | 4/1989 | Nguyen et al. | 73/155 |
| 4,832,128 | 5/1989 | Light et al. | 166/90 |

*Primary Examiner*—John Chapman
*Assistant Examiner*—Kevin D. O'Shea
*Attorney, Agent, or Firm*—Fleit, Jacobson, Cohn, Price, Holman & Stern

[57] ABSTRACT

A radio-active tracer, carried by a pressurized gas, is injected through an axially displaceable tube into a flow stream of steam within a well tubing string to perform a steam injection survey of underground formations intersected by a well bore into which the tubing string extends. The injection tube is guided for displacement from a retracted position at an acute angle to the flow stream direction to an injection position within the tubing string through a riser port, swab valve and steam inlet connection located below a storage zone within a lubricator pipe from which a logging tool is inserted into the tubing string.

19 Claims, 3 Drawing Sheets

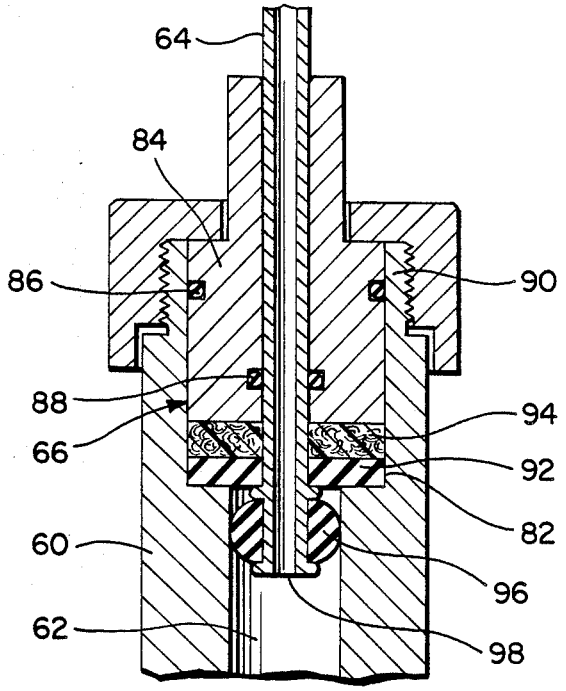
FIG. 3
FIG. 4
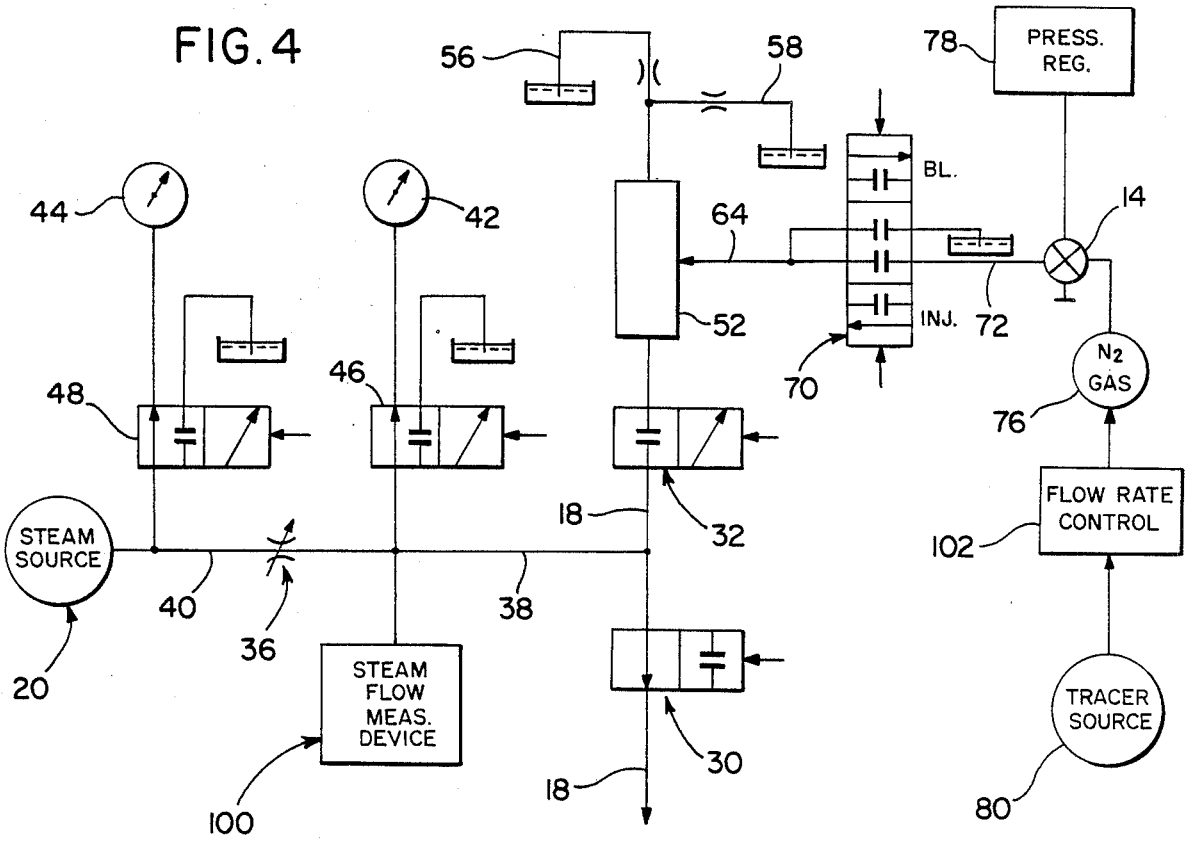

STEAM INJECTION SURVEY APPARATUS AND METHOD FOR TESTING WELLS

BACKGROUND OF THE INVENTION

This invention relates generally to the surveying of underground formations intersected by a well bore, utilizing injected radio-active tracers.

Radio-active tracer materials have been utilized to develop survey profiles of underground formations by injection thereof into a flow of steam introduced into a well bore through which the formations are surveyed. The measured intensity of radiation emitted from such injected tracer materials corresponds to the amount of steam entering the formation being logged at any given station within the well bore. Radiation measurement may be effected by means of a logging tool including, for example, a gamma ray detector such as those disclosed in my prior U.S. Pat. No. 4,096,752. However, measurement methods heretofore utilized involving a radio-active tracer such as I131 has been shown to be inaccurate.

Generally, logging tools have been inserted into the well bore through a tubing string, with its measurement output being delivered to above ground read-out equipment through a wire line extending upwardly through a stuffing box retaining well fluids within the tubing string. The stuffing box is connected to a lubricator pipe, within which the gamma ray detector is stored above ground. A riser fitting and a swab valve through which the logging tool is inserted into the tubing string, couple the lubricator pipe to the tubing string. Steam enters the tubing string below the swab valve while the tracer is injected through the riser fitting. Heretofore, a high pressure bleed valve was removably coupled to the riser fitting to vent well fluids and the lubricator pipe. The radio-active tracer material was also introduced with a pressurized fluid, such as nitrogen gas, through the bleed valve. With the foregoing arrangement, acceptable data was obtainable even though the riser fitting was a substantial distance from the location at which the steam is injected into the tubing string below the riser fitting.

Various drawbacks are associated with the foregoing apparatus arrangement for effecting the steam injection survey, including excessive loss of tracer material during venting and use of large quantities of nitrogen gas to carry the tracer material. Excessive pressure drop losses at elbow connections which distort the slugs of tracer materials injected and the splitting of tracer slugs during injection with over-pressurized nitrogen gas also made survey read-out data difficult to interpret. Also, problems have arisen involving the availability of fully operable bleeder valves. The use of bleeder valves that are not fully operable are a potential hazard.

It is therefore an important object of the present invention to provide apparatus and an associated survey procedure of the foregoing steam injection, tracer detection type which avoids the drawbacks and problems aforementioned.

SUMMARY OF THE INVENTION

In accordance with the present invention, an inflow of steam under pressure regulated by a choke valve is introduced into a tubing string through which a logging tool is inserted into a well bore, upon opening of a swab valve, coupled to the riser fitting more closely spaced from the above ground location at which the steam enters the tubing string from the choke valve. The radiation detector of the logging tool is stored within a lubricator pipe coupled to the riser fitting and closed by a stuffing box through which the wire line extends from the detector to the survey data read-out equipment while retaining well-head fluids. A tracer injection port formation projects from the riser fitting along an injection axis at an acute angle to the axis of the tubing string with which the riser fitting and lubricator pipe are aligned. A flexible injection tube is guided for slidable displacement through the injection port along said injection axis. A stopper seal is mounted on a lower open end of the injection tube for wiping contact within a slide passage of the injection port formation. In a retracted position of the injection tube, the stopper seal abuts the tube guiding means which is provided with a packing nut to releasably hold the injection tube in said retracted position from which it is projected through the riser fitting, the swab valve and the steam inlet to position an open end at a location within the tubing string below the steam inlet. A high pressure injection valve is connected to the injection tube upstream of the injection port to selectively supply thereto a pressurized gas carrying the radio-active tracer material. The inflow rate of the tracer material is regulated to match that of the steam during each well survey operation.

Before a well survey operation is initiated, all valves are closed with the one or two detectors of the logging tool stored within the lubricator pipe. The passage between the source of gas and the closed injection valve is pressurized and checked for leakage upstream of the closed swab valve, while the steam passages downstream thereof are also checked for leakage. Pressure regulated steam is then injected into the tubing string through the normally opened main well head valve while the tool storing lubricator pipe is pressurized by opening and closing of the swab valve. The tracer carrying gas pressure is also regulated to a pressure above well head pressure by a predetermined amount. The logging tool detectors are then inserted through the opened swab valve into the tubing string to a first measuring station within the well bore.

After insertion of the logging tool to its first station, the open end of the injection tube is projected from its retracted position through the riser fitting from which the injection port formation extends to an injection position within the tubing string and below the swab valve and steam inlet, after which the injection valve is momentarily opened to inject a slug of tracer material carried in the pressurized gas at substantially the same inflow rate as the steam. The intensity of the radiation emitted by the tracer material during its entry with the steam into the underground formation at the first station, is then measured by the inserted detector assembly and logged within the data read-out equipment. The detector assembly is then again displaced to the next station at which another slug of tracer material is injected to perform another measurement step. A survey profile of underground formations through the well bore extends is thereby obtained. After the last measurement step is performed at the final and lowest depth station in the well bore, the injection tube is withdrawn to its retracted position, the logging tool is retracted into the tool-storing lubricator pipe and the swab valve is closed. With the injection valve and swab valve closed, the riser fitting and lubricator pipe may be vented through bleeder passages extending from the stuffing box.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWING FIGURES

FIG. 3 is an enlarged partial section view of a portion of the apparatus shown in FIG. 2.

FIG. 4 is a hydraulic circuit diagram corresponding to the apparatus shown in FIGS. 1–3.

DETAILED DESCRIPTION OF PREFERRED EMBODIMENT

Figure 1:
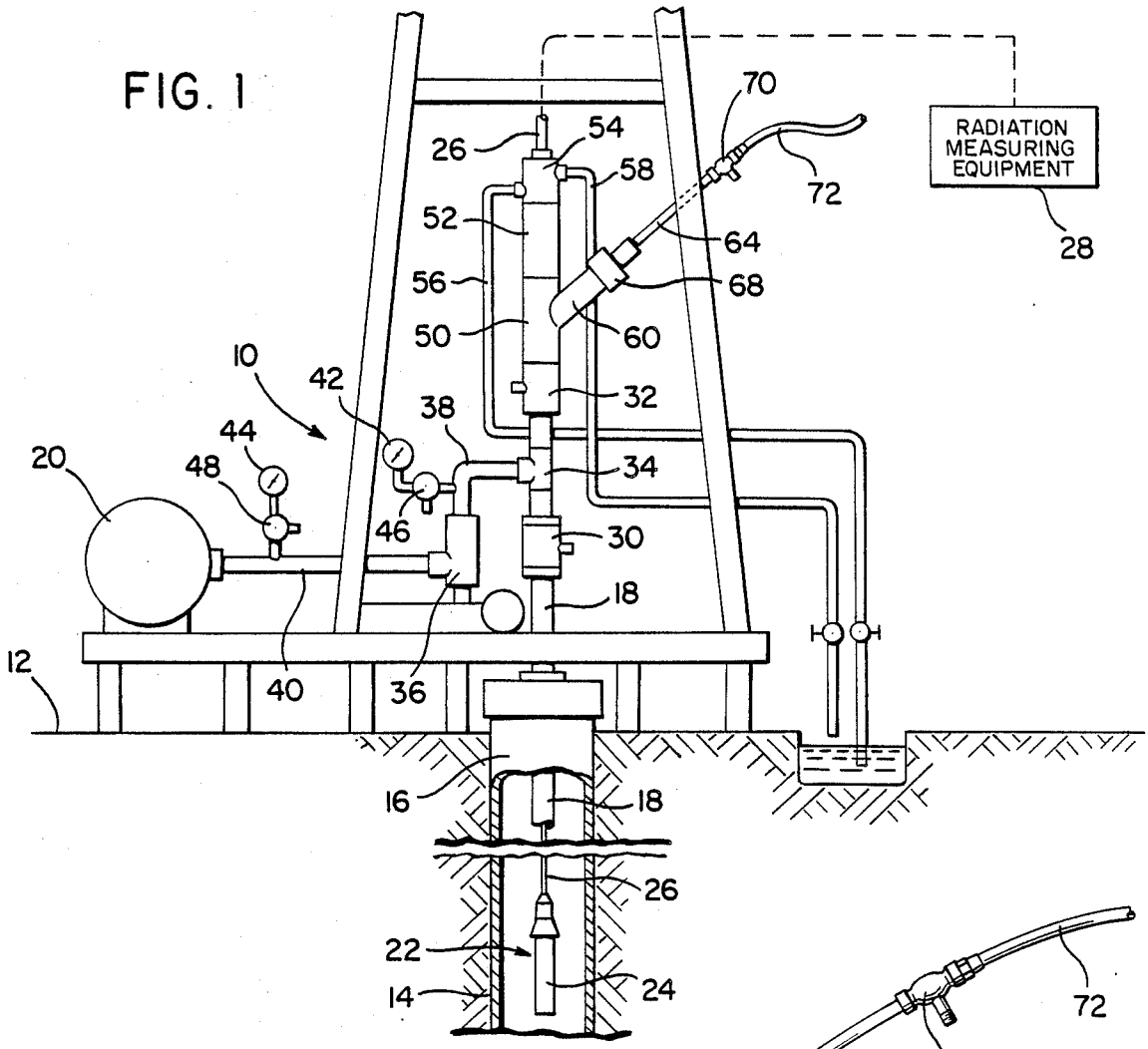
FIG. 1 is a schematic side elevation view of a well-drilling installation with which the apparatus of the present invention is associated.

Referring now to the drawings in detail, FIG. 1 illustrates a typical oil or gas well drilling installation generally referred to by reference numeral 10 at which apparatus associated with the present invention is located above ground level 12 adjacent to a vertical underground well bore 14 adapted to be lined by a well casing 16. A tubing string 18 extends into the well bore casing 16 to conduct a downflow stream of fluid from a pressurized steam source 20 in order to perform a well survey operation utilizing slugs of radio-active tracer material. A logging tool generally referred to by reference numeral 22 is inserted into the well bore through the tubing string 18 for that purpose to detect radiation emitted from the radio-active tracer material and calculate steam inflow velocity from the detection data. The logging tool accordingly includes a gamma ray detector 24 suspended from the lower end of a wire line 26 through which output signals are conducted to radiation measuring equipment 28 above ground as diagrammed in FIG. 1.

The tubing string 18 is connected at its upper end above ground to a main well head valve 30 in axially spaced relation to a swab valve 32. Pressurized steam enters the tubing string between the swab and main well head valves through a right angle, steam inlet tee connection 34 from the pressurized steam source 20. The tee connection 34 is connected to an adjustable choke valve 36 by means of conduit section 38. The pressurized steam source 20 is connected by steam line 40 to the choke valve. Pressure gauges 42 and 44 are respectively interconnected with conduit section 38 and steam line 40 by means of bleed valves 46 and 48 to measure steam line pressure and for bleeding of steam.

As shown in FIG. 1, the logging tool wire line 26 extends into the tubing string 18 through an opened swab valve 32, a riser fitting 50 coupled at its lower end to the swab valve, a lubricator pipe section 52 coupled to the upper end of the riser fitting and a stuffing box 54 closing the upper end of the lubricator pipe section 52 to retain well fluids therebelow while accommodating the slidable displacement of the wire line 26 of the logging tool. High pressure and low pressure bleed lines 56 and 58 extend from the stuffing box.

Figure 2:
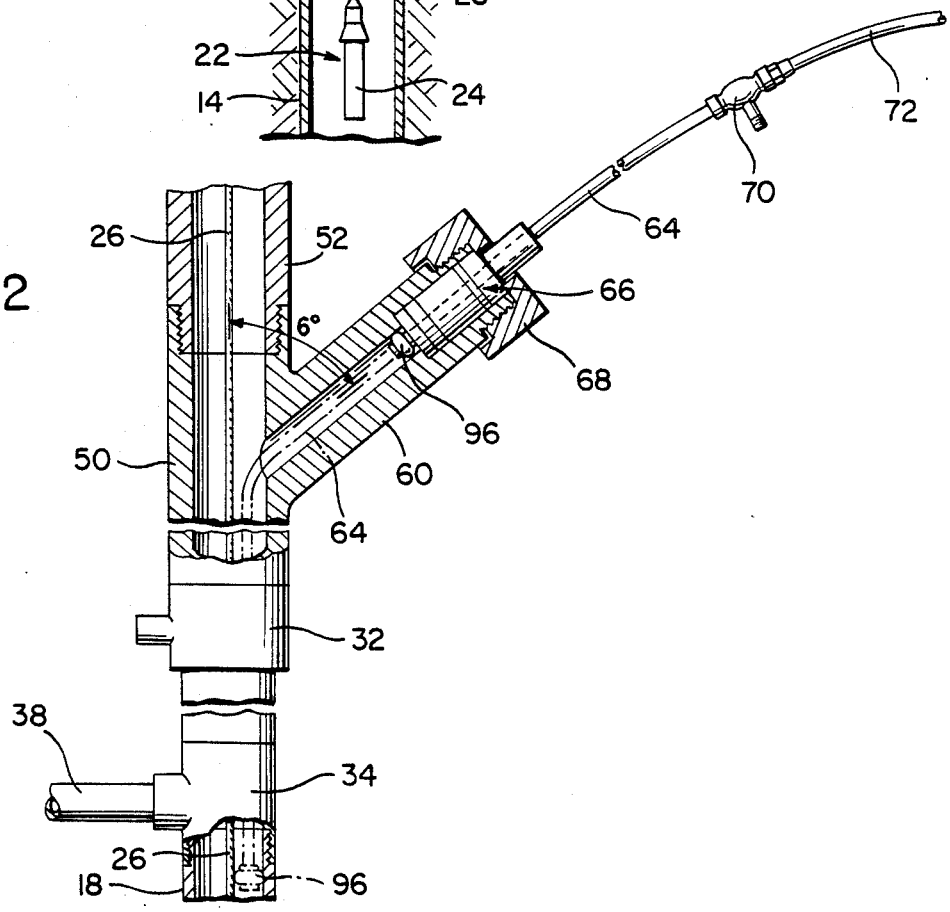
FIG. 2 is an enlarged partial section view and schematic diagram associated therewith relating to a portion of the apparatus shown in FIG. 1.

As more clearly seen in FIG. 2, the lubricator pipe section 52 is dimensioned in internal diameter and axial length to receive and store therein the radiation detector 24 suspended from the lower end of the wire line 26 as shown by dotted line. The internal diameters of the riser fitting 50 and the tubing string 18 are also dimensioned to accommodate displacement therethrough of the detector 24.

As shown in FIGS. 1 and 2, the riser fitting 50 is provided with an injection port formation 60 extending upwardly at an acute angle of approximately six degrees to the common axis of the tubing string 18, riser fitting 50 and lubricator pipe section 52, which are coupled in axial alignment to each other. A slide passage 62 extends through the injection port formation 60 along an injection axis disposed at said acute angle to the axis of the tubing string. An axially displaceable, flexible injection tube 64 projects from the injection port formation 60 through a guide assembly generally referred by reference numeral 66 having a packing nut 68 associated therewith for releasably holding the injection tube 64 in retracted and extended positions. The upper end of the injection tube 64 upstream of the injection port formation 60 has a high pressure injection valve 70 connected thereto through which a pressurized gas carrying radioactive tracer material is selectively supplied to the injection tube from a flexible supply hose 72.

As more clearly seen in FIG. 3, the guide assembly 66 is mounted within an enlarged bore portion 82 of the injection port formation 60 at its upper open end in axial alignment with the slide passage 62 aforementioned. The guide assembly includes an axially displaceable guide plunger 84 disposed within the enlarged bore portion 82 and is provided with radially outer and inner o-ring seals 86 and 88 in wiping contact with the externally threaded end portion 90 of the injection port formation 60 and the injection tube 64. An annular retainer washer 92 is seated on the annular shoulder between the enlarged bore 82 and slide passage 62 in wiping contact with the injection tube 64. Packing 94 made of high temperature resistant material is disposed within the axial space between the guide plunger 84 and retainer washer 92. The packing 94 is accordingly compressed to hold the injection tube 64 in either of its operative positions when the packing nut 68 is threadably tightened.

With continued reference to FIG. 3, a spherical stopper seal 96 is mounted on the lower open end 98 of the injection tube 64 for wiping contact with the walls of the slide passage 62 within the injection port formation 60. In the retracted position of the injection tube 64 shown in FIG. 3, the stopper seal 96 abuts the retainer washer 92 of the guide assembly 66 so as to prevent withdrawal of the injection tube from the injection port formation.

In the opposite extended position of the injection tube 64, the tube projects through the riser fitting 50, the swab valve 32 and the steam inlet connection 34, as shown by dotted line in FIG. 2 with the opened end 98 spaced therebelow adjacent to the wire line 26. When in such extended position, the injection tube conducts an inflow of pressurized gas carrying the tracer material so as to enter the flow stream of steam with minimum pressure drop loss. The acute angular relationship of the injection port formation 60 to the downflow direction of the steam flow along the axis of the tubing string 18 accommodates the displacement of the injection tube 64 to its extended position below the steam inlet connection 34 as shown.

The fluid flow system formed by the valves and conduits hereinbefore described with respect to FIGS. 1–3, are diagrammed in FIG. 4. FIG. 4 also schematically shows a steam flow measuring device 100 connected to the regulated steam inflow conduit section 38. A flow rate control device 102, also diagrammed in FIG. 4, regulates the inflow rate of the tracer material from source 80 so that it may be matched with that of the steam as measured by device 100 in accordance with one aspect of the present invention. With valves 32 and 70 closed, the detector 24 of the logging tool will be stored within the lubricator tube section 52 as aforementioned. The pressurized steam in lines 38 and 40 may accordingly be checked for leakage through pressure gauges 42 and 44 while the supply line 72 between the source 76 of gas and the injection valve 70 may be pressurized to a pressure of 1000 psi, for example, by opening of valve 74. Choke valve 36 regulates the steam pressure while regulator 78 controls the pressure of the inflowing gas from source 76. A well survey operation may then be initiated by injection of steam into the well bore and opening of the swab valve 32.

Figure 5:
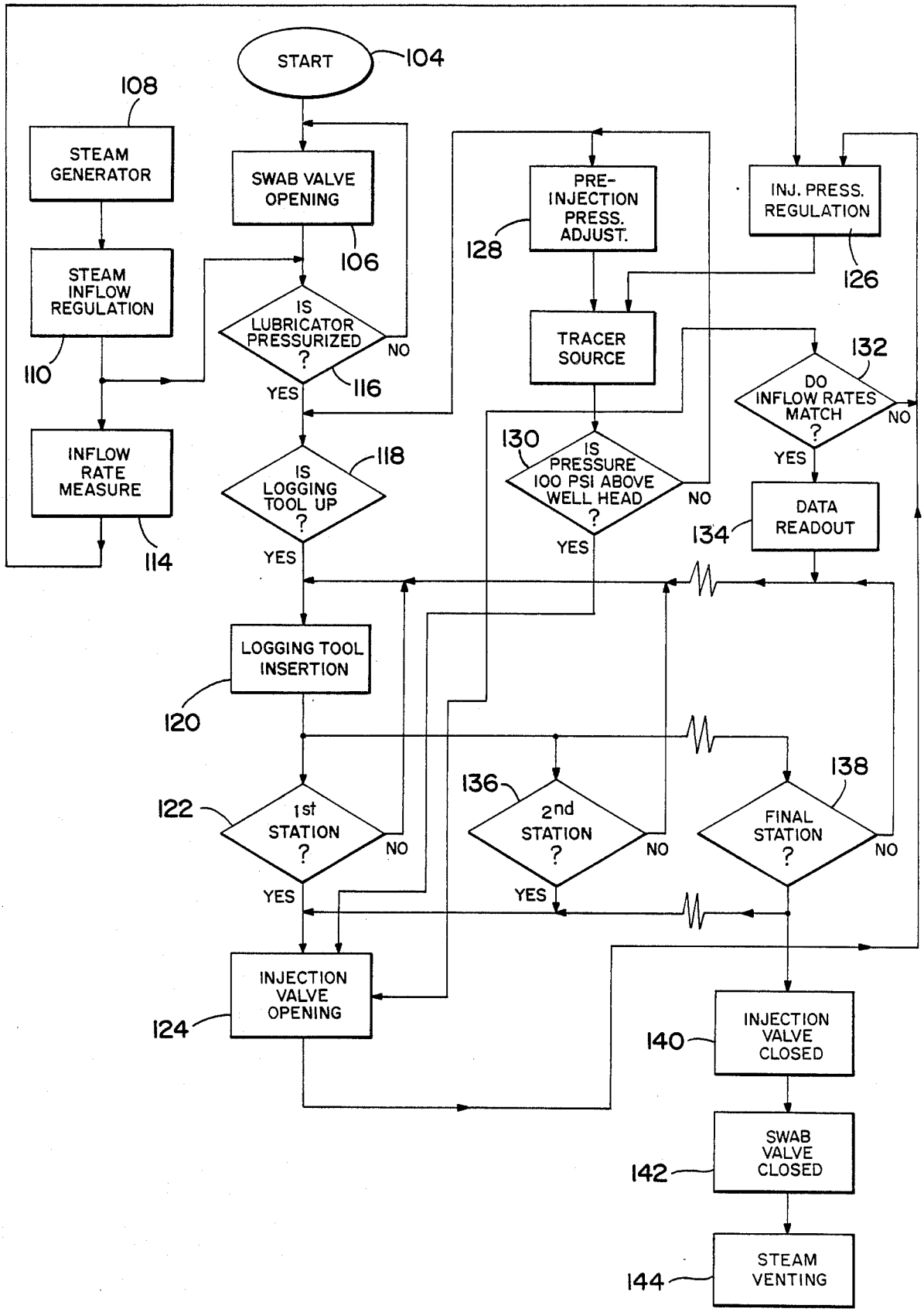
FIG. 5 is a typical program flow chart corresponding to the method associated with the present invention.

The program flow chart of FIG. 5 diagrams the well survey method associated with the apparatus hereinbefore described. The survey operation is initiated at start 104 by the swab valve opening operation at 106. Initiation of the well surveying operation must, of course, be preceded by the injection of steam into the tubing string through normally open valve 30 and by steam generation 108 and steam inflow regulation 110 to institute an inflow rate measurement 114 for the steam. If the lubricator pipe section 52 is then pressurized by the inflowing steam, as reflected at decision block 116, the program proceeds after it is determined that the logging tool is in operative condition as reflected at decision block 118. If in an operable condition, the logging tool undergoes an insertion 120 until it reaches the first measurement station within the well bore as reflected at decision block 122. The injection valve 70 is then opened as reflected by the operation 124 diagrammed in FIG. 5 initiating injection pressure regulation 126 of the tracer source. Such injection pressure regulation is compared with the inflow rate measurement in order to change the previous injection pressure to which the tracer source was adjusted at 128 when the lubricator was pressurized. The injection inflow rate is thereby matched with that of the steam in order to perform a measurement.

As diagrammed in FIG. 5, the pre-injection pressure adjustment 128 is arranged to raise the tracer gas pressure 100 psi above well head pressure as reflected by decision block 130, a condition required before opening of the injection valve 70 by the valve opening operation 124. Subsequent injection pressure regulation during injection of the tracer involves matching of the inflow rates as reflected at decision block 132 before data readout operation 134 is effected.

Following data readout at the first station of the logging tool detectors, a further insertion operation 120 is effected for the logging tool until a second measurement station is reached as reflected by decision block 136 to initiate another measurement terminated by data readout operation 132 as a result of momentary opening operation 124 of the injection valve. The measurement operation is repeated at each of the measuring stations until final measurement is performed at the final station as reflected at decision block 138. The injection valve 70 is then maintained closed as indicated by operational block 140 followed in sequence by closing operation 142 for the swab valve 32 and venting 144 of the steam to complete the survey procedure.

The foregoing is considered as illustrative only of the principles of the invention. Further, since numerous modifications and changes will readily occur to those skilled in the art, it is not desired to limit the invention to the exact construction and operation shown and described and, accordingly, all suitable modifications and equivalents may be resorted to, falling within the scope of the invention.

WHAT IS CLAIMED AS NEW IS AS FOLLOWS:

1. In combination with a method of surveying an underground formation through a well bore, which includes the steps of: inserting a logging tool into the well bore from an above ground storage location for detection of downhole radiation at the formation; conducting a flow stream of steam into the well bore from another above ground location downstream of said storage location for entry of the steam into the formation; and injecting a radio-active tracer into the flow stream to determine inflow velocity of the steam during said entry into the formation as a function of radiation detection by the logging tool; the improvement comprising, the steps of: pressurizing said storage location with the steam from the flow stream prior to said insertion of the logging tool into the well bore and said injection of the tracer; and effecting said injection of the tracer into the flow stream downstream of said other above ground location.

2. The improvement as defined in claim 1 wherein said step of injecting the tracer includes the steps of: establishing a source of tracer carrying gas under pressure; adjusting the pressure of the gas to a level above that of well head pressure in the well bore; and regulating flow of the gas during injection into the flow stream of the steam.

3. The improvement as defined in claim 2 including the steps of: measuring the inflow rate of the steam in the flow stream entering the well bore; and adjusting the regulated flow of the gas during injection to substantially match the measured inflow rate of the steam with inflow rate of the tracer.

4. The improvement as defined in claim 3 wherein said step of injecting the tracer further includes the steps of: conducting the tracer carrying gas through an injection tube; displacing said injection tube between a retracted position spaced from the flow stream and an injection position within the flow stream; blocking inflow of the gas into the injection tube while in the retracted position; and effecting said regulation of the flow of the gas while the injection tube is in the injection position.

5. The improvement as defined in claim 2 wherein said step of injecting the tracer further includes the steps of: conducting the tracer carrying gas through an injection tube; displacing said injection tube between a retracted position spaced from the flow stream and an injection position within the flow stream; blocking inflow of the gas into the injection tube while in the retracted position; and effecting said regulation of the flow of the gas while the injection tube is in the injection position.

6. The improvement as defined in claim 1 wherein said step of injecting the tracer includes the steps of: establishing a source of gas under pressure; adjusting the pressure of the gas to a level above that of well head pressure in the well bore; and carrying the tracer in the gas during injection thereof into the flow stream of the steam.

7. The improvement as defined in claim 6 including the steps of: measuring the inflow rate of the steam in the flow stream entering the well bore; and adjusting flow of the gas during injection to substantially match the measured inflow rate of the steam with inflow rate of the tracer.

8. The improvement as defined in claim 6 wherein said step of injecting the tracer further includes the steps of: conducting the tracer carrying gas through an injection tube; displacing said injection tube between a retracted position spaced from the flow stream and an injection position within the flow stream; blocking inflow of the gas into the injection tube while in the retracted position; and regulating the inflow rate of the tracer into the gas while the injection tube is in the injection position.

9. In a method of surveying an underground formation by injecting a radio-active tracer into a flow stream of steam conducted to the formation through a well bore from an above-ground steam inlet location and detecting radiation emitted by the tracer by means of a logging tool, the steps of: storing the logging tool in a storage zone above the steam inlet location prior to insertion of the logging tool into the well bore; pressurizing said storage zone with the steam prior to said insertion of the logging tool and said injection of the tracer; and introducing a pressurized fluid carrying the tracer into the flow stream from a location within the flow stream below the steam inlet location to effect said injection of the tracer.

10. The method of claim 9 wherein said step of introducing the tracer carrying fluid, includes: conducting the fluid through an injection tube extending at the acute angle to the flow stream; displacing the injection tube from a retracted position spaced from the flow stream to an extended position within the flow stream; blocking flow of the fluid through the injection tube while in the retracted position; and regulating the inflow of the tracer and the fluid into the flow stream through the injection tube while in the extended position thereof.

11. The method of claim 10 including the steps of: measuring inflow of the steam in the flow stream into the well bore; and adjusting said regulated inflow of the tracer to substantially match that of the measured inflow of the steam.

12. The method of claim 9 including the steps of: measuring inflow of the steam and the tracer into the well bore; and adjusting the inflow of the tracer to substantially match that of the steam in inflow rate.

13. In a method of surveying an underground formation by injecting a radio-active tracer into a flow of steam conducted to the formation from an inlet location and detecting radiation emitted by the tracer by means of a logging tool, the steps of: conducting fluid carrying the tracer through an injection tube; displacing the injection tube between a retracted position and an extended position within the flow of steam downstream of said inlet location; blocking flow of the fluid through the injection tube while in the retracted position; and regulating flow of the tracer and the fluid during inflow thereof into the steam through the injection tube while in the extended position.

14. The method of claim 13 including the steps of: measuring inflow of the steam; and adjusting said regulated flow of the tracer to substantially match that of the measured inflow of the steam.

15. In a method of surveying an underground formation by injecting a radio-active tracer into a flow stream of steam conducted to the formation from an inlet location through a well bore and detecting radiation emitted by the tracer by means of a logging tool inserted into the well bore, the steps of: storing the logging tool in a storage zone above the steam inlet location prior to insertion of the logging tool into the well bore; pressurizing said storage zone with the steam prior to said insertion of the logging tool and said injection of the tracer; introducing a pressurized fluid carrying the tracer into the flow stream between the steam inlet location and the well bore; and regulating inflow of the tracer into the flow stream.

16. The method of claim 15 including the steps of: measuring inflow of the steam and the tracer into the well bore; and adjusting the inflow of the tracer to substantially match that of the steam in inflow rate.

17. For use in a system of surveying an underground formation through a well bore receiving a flow stream of steam and a logging tool adapted to detect radiation emitted from a radioactive tracer within the steam, apparatus for injecting the tracer into the flow stream entering the well bore comprising, tubing means extending into the well bore for receiving the logging tool therein and conducting said steam in the flow stream along a vertical axis, an injection riser, a lubricator connected to the injection riser enclosing a storage zone within which the logging tool is retracted from the well bore, swab valve means connecting the tubing means to the injection riser for alternatively pressure sealing the tubing means from the storage zone with the logging tool retracted therein and guiding insertion of the logging tool into the well bore through the tubing means, injection port means connected to the riser for establishing an injection axis intersecting the vertical axis of the flow stream at an acute angle, a displaceable injection tube having an open stopper end portion, means connected to the injection port means for guiding displacement of the injection tube along said injection axis between retracted and extended positions with said stopper end portion respectively within the port means and within the tubing means, a source of pressurized fluid carrying the tracer and injection valve means connecting said source to the injection tube for supply of the tracer thereto at a regulated inflow rate.

18. In combination with a tubing string for a well to which a steam line is connected above ground, a logging tool assembly having a radiation detecting device and an elongated wire line extending therefrom, a stuffing box through which the wire line extends while blocking outflow of well fluids, a lubricator pipe connected to the stuffing box and enclosing the radiation detecting device in a storage position, a tubular riser coupled to the lubricator pipe and a swab valve interconnecting the riser and the tubing string in axial alignment with each other above the steam line, means for injecting a radio-active tracer into the tubing string, including an injection port mounted on the riser having an injection axis at an acute angle to the riser and the tubing string, an injection tube through which the tracer is conducted, means mounted by the injection port for slidably guiding displacement of the injection tube along said injection axis thereof from a retracted position to an extended position below the steam line within the tubing string.

19. The combination of claim 18 including means engageable with the slidable guiding means for releasably holding the injection tube in said extended position thereof and in said retracted position.

* * * * *